United States Patent [19]

Kaneko

[11] Patent Number: 4,463,463

[45] Date of Patent: Aug. 7, 1984

[54] ADJUSTABLE BED

[75] Inventor: Kenichi Kaneko, Kariya, Japan

[73] Assignee: Aisin Seiki Kabushiki Kaisha, Kariya, Japan

[21] Appl. No.: 246,671

[22] Filed: Mar. 23, 1981

[30] Foreign Application Priority Data

| | | | |
|---|---|---|---|
| Mar. 28, 1980 | [JP] | Japan | 55-040589 |
| Apr. 14, 1980 | [JP] | Japan | 55-049489 |
| Jun. 4, 1980 | [JP] | Japan | 55-075060 |

[51] Int. Cl.[3] ..... A61G 7/06; A61G 7/00

[52] U.S. Cl. ..... 5/68; 5/69; 5/424

[58] Field of Search ..... 5/66, 67, 68, 69, 60, 5/70, 72, 80, 424

[56] References Cited

U.S. PATENT DOCUMENTS

| | | | |
|---|---|---|---|
| 2,605,481 | 8/1952 | Burkhart | 5/69 |
| 3,012,253 | 12/1961 | Reichert | 5/68 |
| 3,965,500 | 6/1976 | Stein | 5/68 |
| 4,361,917 | 12/1982 | Wilson | 5/69 |

*Primary Examiner*—Alexander Grosz

*Attorney, Agent, or Firm*—Oblon, Fisher, Spivak, McClelland & Maier

[57] ABSTRACT

An adjustable bed having a frame in which a movable board and a stationary board are arranged in a planar relationship and the movable board is movable out of the plane of the stationary board by a motor wherein a switch included in a circuit for controlling the motor is turned off by a detector when a portion of a human body is caught between the frame and the movable board during lowering thereof, thereby preventing injury to the body.

10 Claims, 16 Drawing Figures

ADJUSTABLE BED

BACKGROUND OF THE INVENTION

1. Field of the Invention

This invention relates to an adjustable bed, and more particularly to an electrically operated adjustable bed.

2. Description of the Prior Art

There has been provided an adjustable bed wherein a head end portion (or a foot end portion) of a bedboard may be raised so as to elevate the head (or the feet) of the user. In an electrically operated adjustable bed, the head end portion (or the foot end portion) is raised by a motor through a mechanism. However, the conventional electrically operated adjustable bed has a drawback in that a portion of the human body (especially, a foot or a hand) can sometimes be caught between the frame and the movable portion of the bedboard during lowering thereof resulting in injury to that portion of human body.

SUMMARY OF THE INVENTION

It is, therefore, one of the objects of this invention to provide an electrically operated adjustable bed without the aforementioned drawback.

It is another object of this invention to provide an electrically operated adjustable bed having a safety mechanism for preventing injury to the human body.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
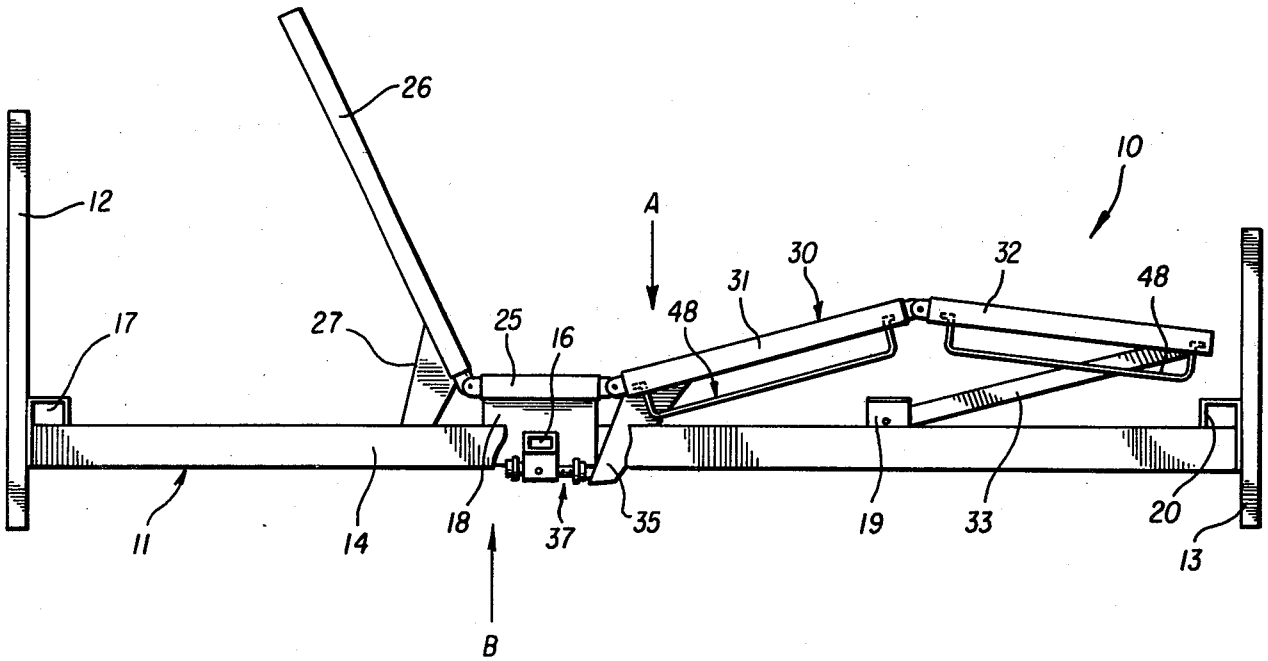
FIG. 1 is a side view of a first embodiment of an adjustable bed in accordance with this invention.
Figure 2:
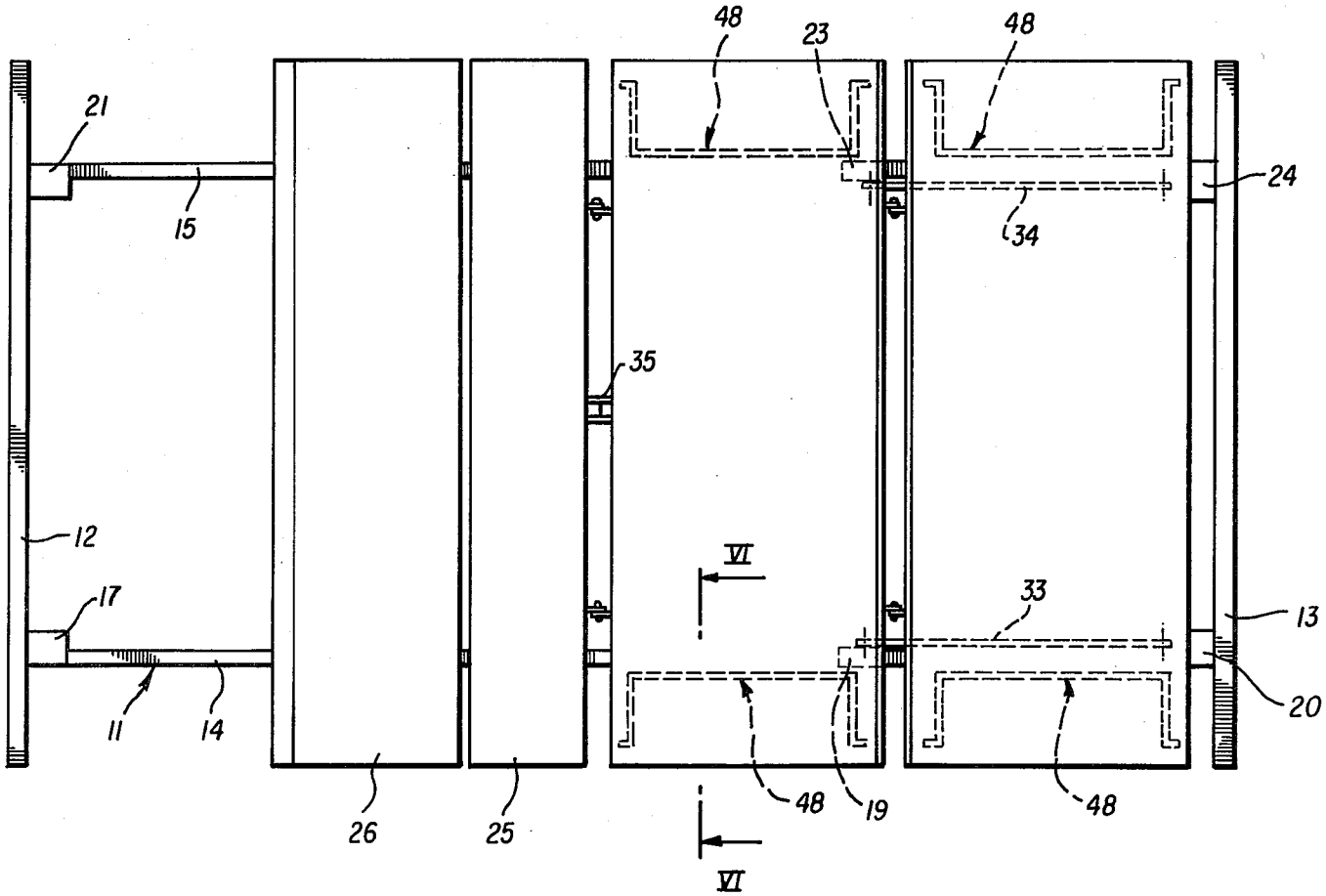
FIG. 2 is an upper plane view as seen in an arrowed direction A in FIG. 1.

Referring now to FIGS. 1 through 8, an electrically operated adjustable bed 10 includes a frame 11. Frame 11 includes a head board 12, a foot board 13 longitudinally spaced therefrom, a pair of laterally spaced beams 14 and 15 for connecting boards 12 and 13, and a pipe 16 whose opposite ends are respectively affixed below beams 14 and 15.

On beam 14 are fixed a first supporting member 17, a second supporting member 18, a third supporting member 19, and a fourth supporting member 20. First supporting member 17 is positioned at a corner formed between board 12 and beam 14. Fourth supporting member 20 is positioned at a corner formed between board 13 and beam 14. Similarly, a fifth supporting member 21 laterally opposing first supporting member 17, a sixth supporting member 22 laterally opposing second supporting member 18, a seventh supporting member 23 laterally opposing third supporting member 19, and an eighth supporting member laterally opposing fourth supporting member 20 are provided 24 fixed to beam 15.

A stationary board 25 is fixed at opposite ends thereof to supporting members 18 and 22. A movable head board 26 is pivotably connected to a left end portion of stationary board 25. Board 26 is provided at the lower side thereof with a pair of arms 27 extending downwardly in an outwardly inclined direction. Arms 27 are operatively connected to a motor 29 through a transmitting mechanism 28 so that arms 27 may be pushed or pulled in the longitudinal direction upon operation of motor 29. Thus, board 26 may be movable out of the horizontal plane normally formed by board 25.

A movable foot board 30 is divided into a first section 31 and a second section 32. A right end portion of first section 31 is pivotably connected to a left end portion of second section 32. A left end portion of first section 31 is pivotably connected to a right end portion of stationary board 25. A right end portion of second section 32 is pivotably connected to right end portions of a pair of laterally spaced arms 33 and 34. Left end portions of arms 33 and 34 are respectively pivotably connected to supporting members 19 and 23.

A pair of arms 35 are extended downwardly in an outwardly inclined direction from a lower side of first section 31 and are operatively connected to a motor 38 through a drive transmitting mechanism 37 so that first section 31 may be movable out of the horizontal plane in conjunction with second section 32.

Figure 3:
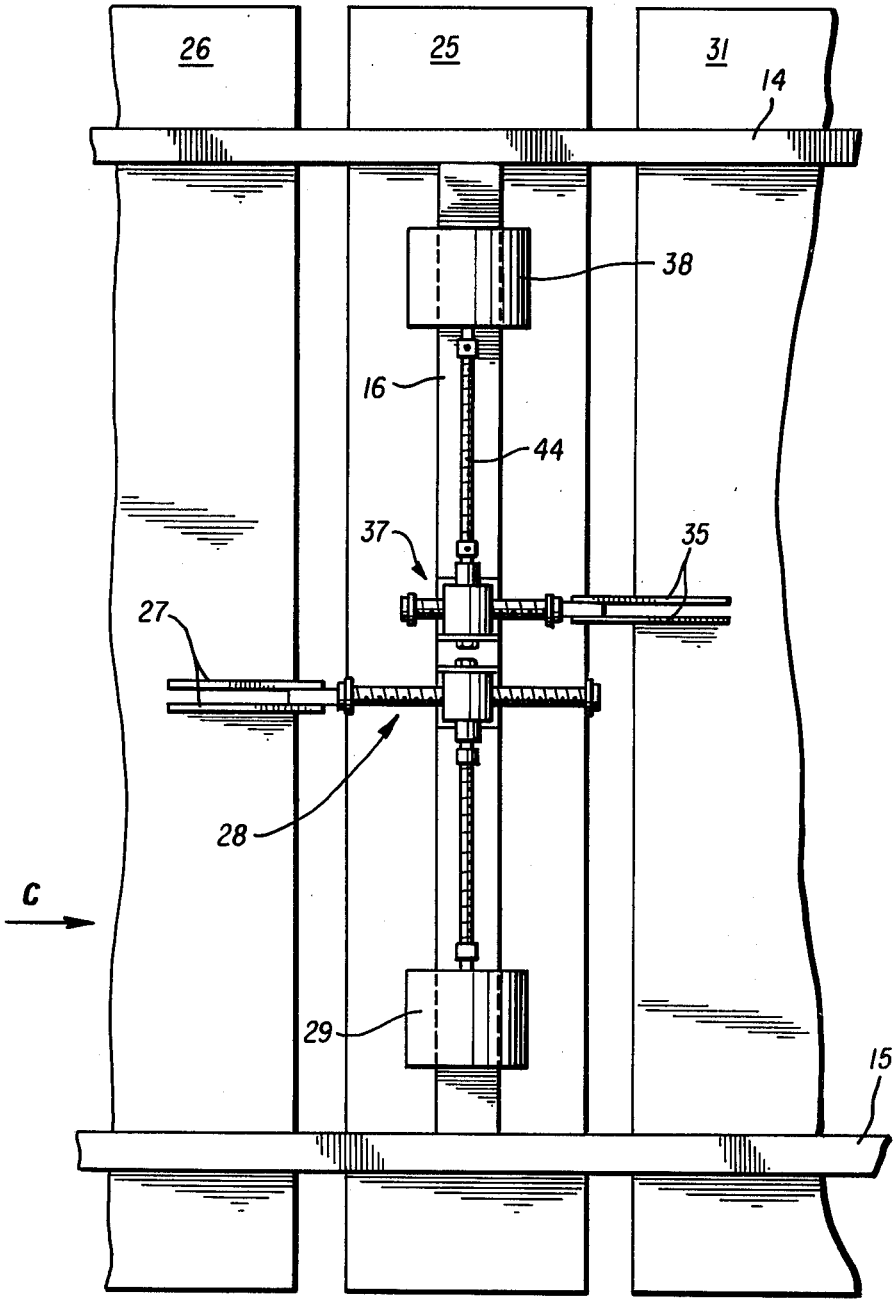
FIG. 3 is a lower plane view as seen in an arrowed direction B in FIG. 1.
Figure 4:
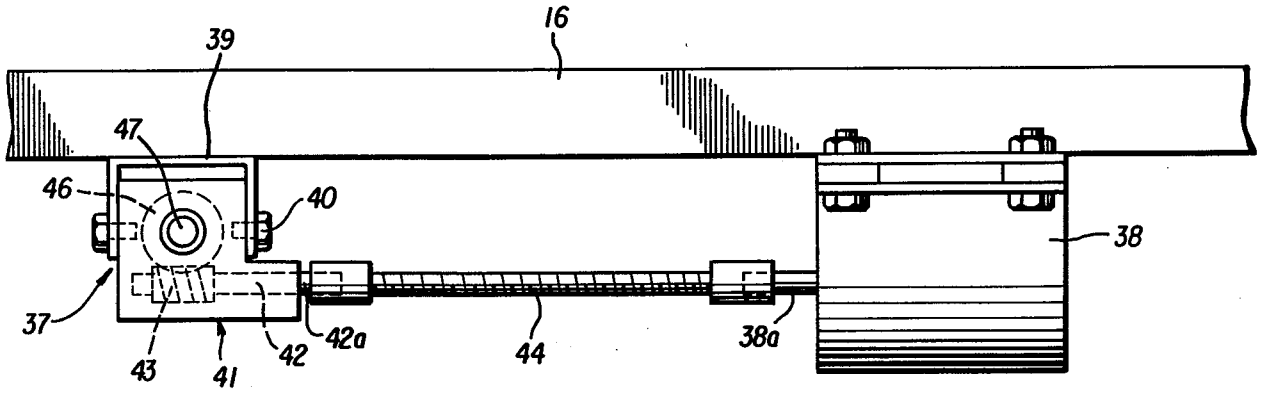
FIG. 4 is a side view as seen in an arrowed direction C in FIG. 3.
Figure 5:
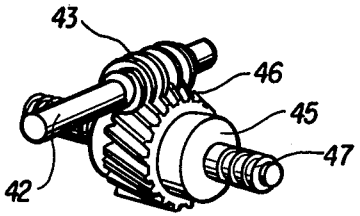
FIG. 5 is a perspective view of the interior of a gearbox in a drive transmitting mechanism.
Figure 6:
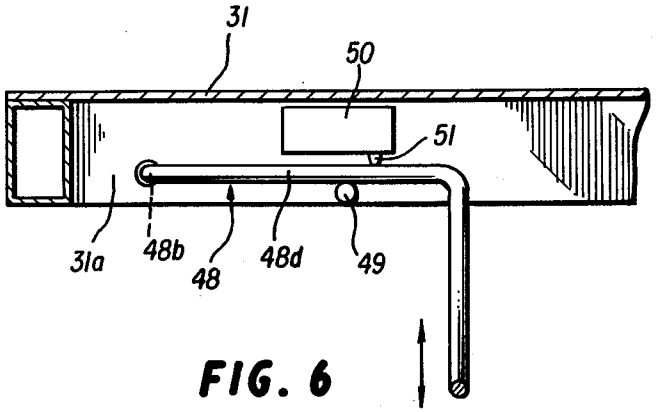
FIG. 6 is a view showing the relationship between a switch and a lever.

Drive transmitting mechanism 37 is now explained in greater detail with reference to FIGS. 3, 4 and 5. A bracket 39 is welded to pipe 16 and a gearbox 41 is held in bracket 39 by a screw member 40. A shaft 42 is provided in gearbox 41 with a worm gear 43 at one end and another end portion **42*a* of shaft 42 is projected from box 41. End portion 42*a* of shaft 42 is connected to an axle 38*a* of motor 38 by means of a drive shaft 44. A sleeve 45 is rotatably mounted to box 41 while a gear 46 is fixedly mounted on sleeve 45 and is in mesh engagement with gear 43. A threaded shaft 47 is passed through a tapped hole in sleeve 45 and is connected to arms 35. Thus, shaft 47 may be projected or retracted in accordance with rotation of axle 38***a* of motor 38 upon operation thereof, and board 30 may be raised or lowered relative to frame 11.

Four identical levers 48 are provided on lower opposite sides of the first and second sections 31 and 32. Lever 48 may be obtained by bending a single wire and has a central portion 48*a*, opposite end portions 48*b* and 48*c* unevenly parallelly spaced to central portion 48*a*, a first bent portion 48*d* formed into an inverted L-shape for connecting end portion 48*b* to central portion 48*a*, and a second bent portion 48*e* similar to first bent portion 48*d* for connecting end portion 48*c* to the central portion. Opposite end portions 48*a* 48*b* and 48*c* are respectively rotatably supported to a pair of longitudinally spaced side walls 31*a* (only one shown). A horizontal portion of bent portion 48*d* is supported by a pin 49 driven into side wall 31*a*. A limit switch 50 with an extension 51 is fixed to the side wall 31*a* so that extension 51 is pushed by the horizontal portion of the bent portion 48*d* upon counterclockwise rotation of the horizontal portion about end portion 48*b*, thereby stopping motor 38.

Figure 8:
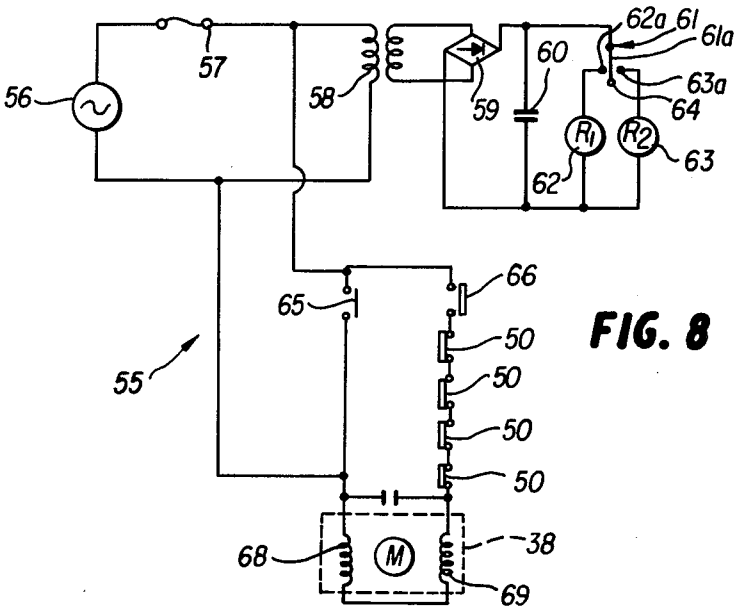
FIG. 8 is a circuit diagram showing a circuit for controlling a motor.
Figure 7:
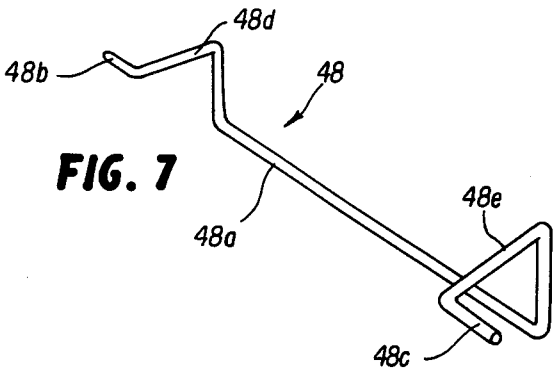
FIG. 7 is a perspective view of a lever.
Figure 9:
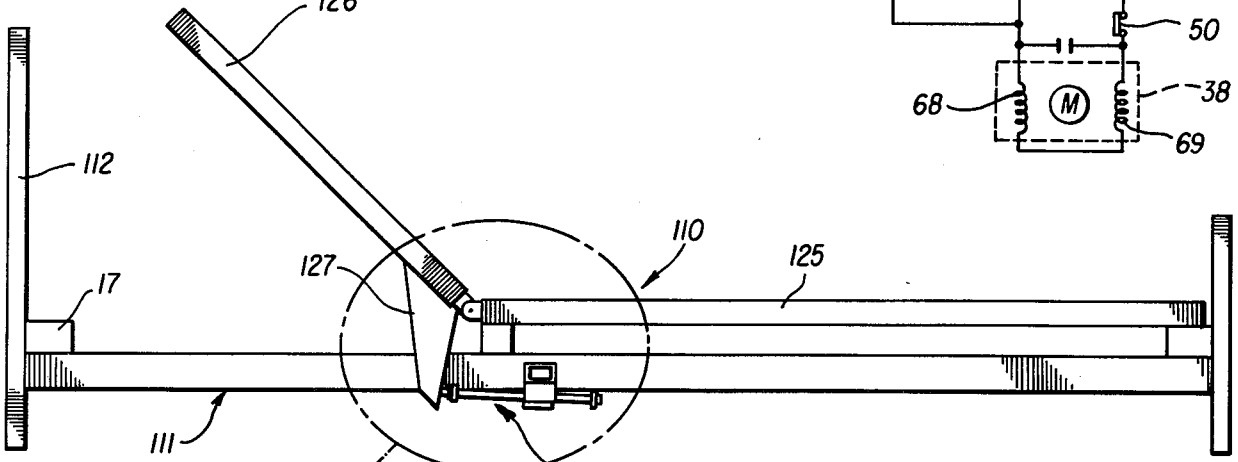
FIG. 9 is a side view of a second embodiment of an adjustable bed.
Figure 10:
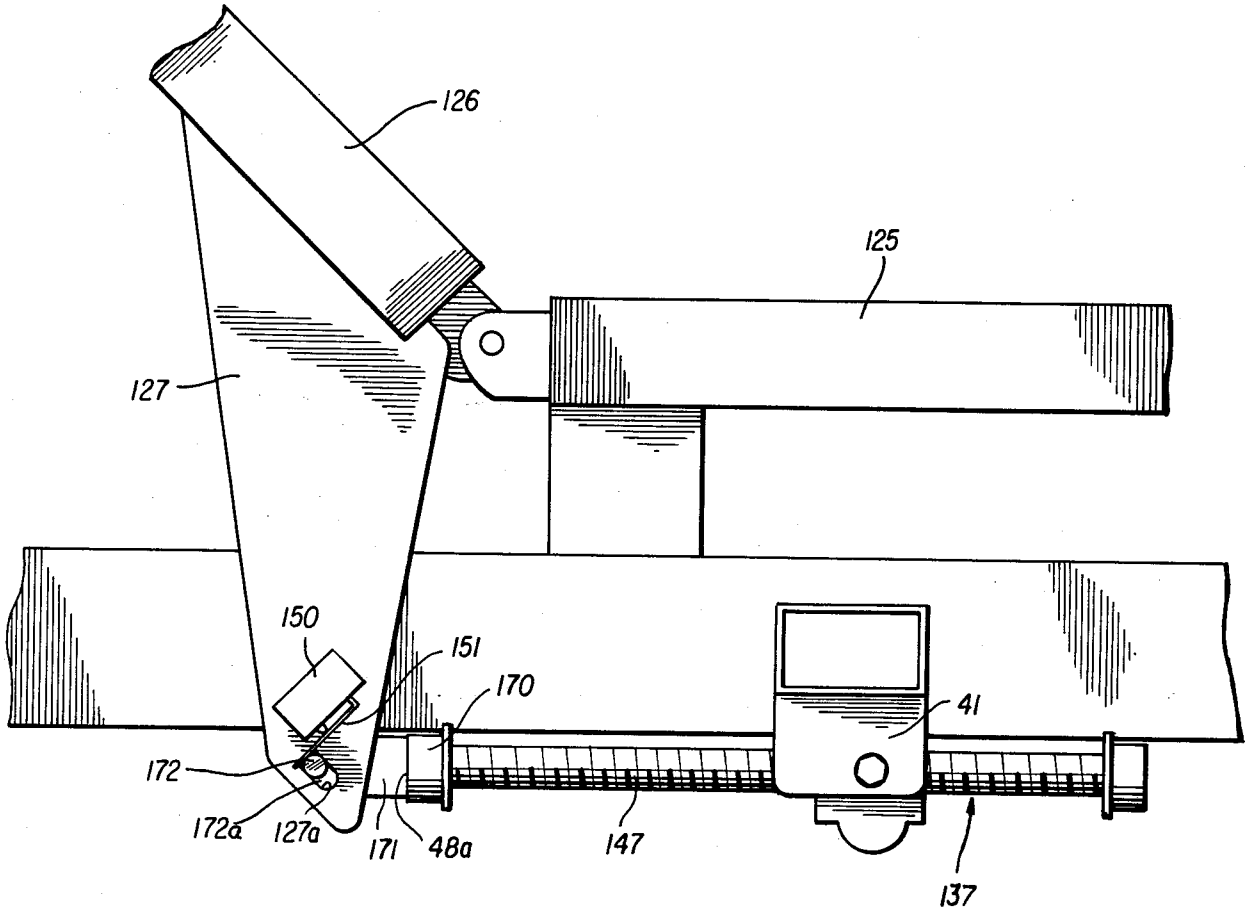
FIG. 10 is an enlarged view of a portion encircled by area D in FIG. 9.

An electric circuit 55 for driving the motor 38 is explained hereinafter with reference to FIG. 8 wherein a power supply 56, a fuse 57, a transformer 58, a rectifier 59, a condensor 60, a change-over switch 61, a first relay 62, a second relay 63, a neutral point 64, a contact 65 of the first relay 62, a contact 66 of the second relay 63, a condensor 67, a main-coil 68 of the motor 38, and an auxiliary coil 69 of the motor 38 are illustrated. A lever 61*a* of change-over switch 61 may be connected to a terminal 62*a* of first relay 62, a terminal 63*a* of second relay 63, or the neutral point 64. Four limit switches 50 are connected in series and are held respectively in an "on" condition.

In operation, when lever 61*a* of change-over switch 61 is connected to terminal 62*a*, motor 38 is driven and axle 38*a* thereof is rotated in a first direction. This rotation is transmitted to drive transmitting mechanism 37. That is to say, when this rotation is transmitted to shaft 42 by drive shaft 44, gear 43 is rotated together with shaft 42 with the result that gear 46 and sleeve 45 are rotated in the first direction. Thus, shaft 47 is advanced or projected so as to move arm 35, thereby raising movable board 30, i.e. moving first section 31 out of the horizontal plane in conjunction with second section 32. Under this condition, when lever 61*a* is brought into connection with neutral terminal 64, rotation of axle 38*a* ceases.

On the contrary, when lever 61*a* is connected to terminal 63*a*, axle 38*a* of motor 38 is rotated in a second direction opposite that of the first direction. Thus, movable board 30 is lowered, i.e. first section 31 and second section 32 are so rotated that both sections 31 and 32 may be brought into horizontal position with one another. During lowering of the movable board 30, when a portion of the human body such as a foot or a hand is caught between central portion 48*a* of lever 48 and beam 14 or 15 of frame 11, the horizontal portion of bent portion 48*d* of lever 48 is raised, thereby contacting extension 51 of limit switch 50. Thus, limit switch 50 is brought into an "off" condition with the result that motor 38 is stopped. Consequently, injury of that portion of the human body is avoided.

Next, referring to the FIGS. 9 through 12 wherein an electrically operated adjustable bed 110 is illustrated. In bed 110, a movable board 126 is disposed at a left end portion thereof and is pivotably connected at its right end portion to a left end portion of a stationary board 125. Movable board 126 is connected to stationary board 125 and a pair of laterally spaced arms 127 and 127' extend downwardly in an outwardly inclined direction from a lower side of movable board 126.

Arm 127 is provided with a slot 127*a* and arm 127' is provided with a slot 127'*a* identical and corresponding to slot 127*a*. A drive transmitting mechanism 137 identical to the aforementioned mechanism 37 of the first embodiment (see FIG. 3) is provided below frame 111. A shaft 147 of transmitting mechanism 137 may be advanced or retracted in accordance with rotation of an axle (not shown) of a motor 138 (not shown) in a first or second opposite direction as described hereinbelow.

A cap 170 with a tongue portion 171 is provided at a left end portion of shaft 147. A pin 172 is fixed to tongue portion 171 of cap 170 and opposite end portions 172*a* (only one of which is shown) of tongue portion 171 are in sliding engagement with slots 127*a* and 127'*a* respectively. Movable board 126 and the pair of arms 127 and 127' are rotatable downward onto frame 111. A limit switch 150 with a lever 151 is provided on arm 127.

Figure 12:
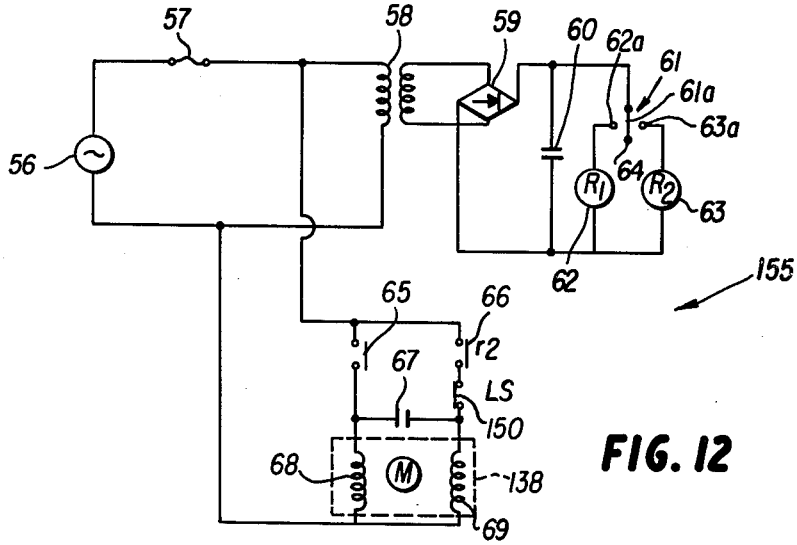
FIG. 12 is a circuit diagram showing a circuit for controlling the motor of the adjustable bed in FIG. 9.

Limit switch 150 is so designed that switch 150 is normally held in an on condition by lever 151 in pushed-engagement with limit switch 150. A pin 172 of end portion 172*a* normally holds lever 151 in pushed-engagement with limit switch 150 and pin 172 is positioned at one end wall of slot 127*a* by means of shaft 147 (see FIG. 10). When a portion of the human body is caught between frame 111 and movable board 126 during lowering movement thereof, pin 172 is disengaged from one end wall of slot 127*a* and slidably moves within slot 127*a*. Movement of pin 172 causes lever 151 to rotate counterclockwise out of electrical contact with limit switch 150 (see FIG. 10). Thus, limit switch 150 is brought into an off condition, thereby stopping motor 138 to prevent further rightwardly movement of shaft 147 and thus, rotation of movable board 126 is stopped. An electric circuit 155 for driving motor 138 shown in FIG. 12 is identical to circuit 55 shown in FIG. 8 except there is only one limit switch 150 in circuit 155 but there are four limit switches 50 in circuit 55.

In circuit 155 when lever 61*a* of switch 61 engages contact 62*a*, motor 138 rotates to move the shaft 147 to the left (see FIG. 10) through transmission mechanism 137. The leftwardly movement of shaft 147 rotates movable board 126 in a clockwise direction, i.e., pivotally raising movable board 126 out of the horizontal plane of stationary board 125, by means of arms 127, 127'. When the movable board 126 is rotated to a predetermined position, lever 61*a* is moved to neutral point 64 and motor 138 is disengaged. Movable board 126 will be maintained in the predetermined position by shaft 147 engaging slots 127*a*, 127'*a* of arms 127, 127' through opposite end portions 172*a*. When lever 61*a* engages contact 63*a*, motor 138 reversely rotates such that shaft 147 is moved to the right (see FIG. 10). Rightwardly movement of shaft 147 rotates movable board 126 in a counterclockwise direction, i.e., pivotally lowering movable board 126 into the horizontal plane of stationary board 125, due to the weight of movable board 126.

Figure 11:
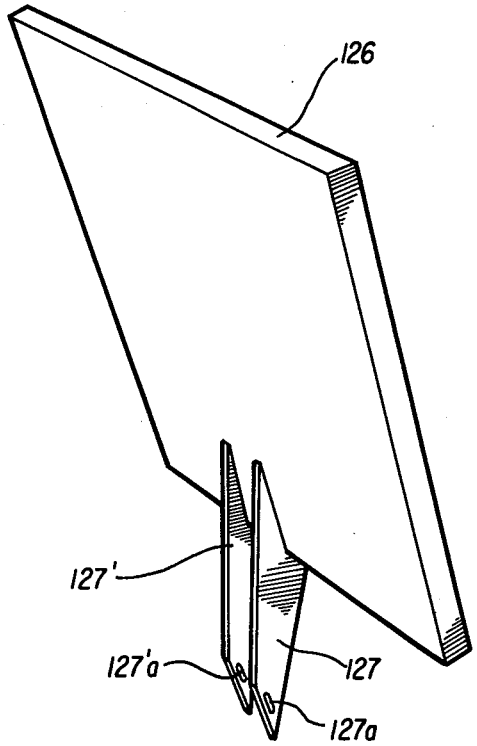
FIG. 11 is a perspective view of a movable board with an arm mechanism of the adjustable bed in FIG. 9.
Figure 14:
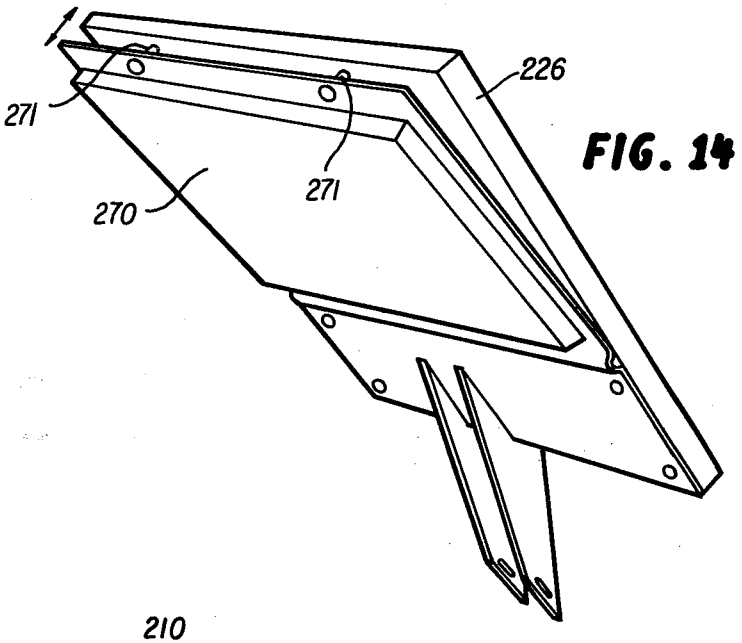
FIG. 14 is a perspective view of a movable board with an arm mechanism and a panel of an adjustable bed in FIG. 13.
Figure 13:
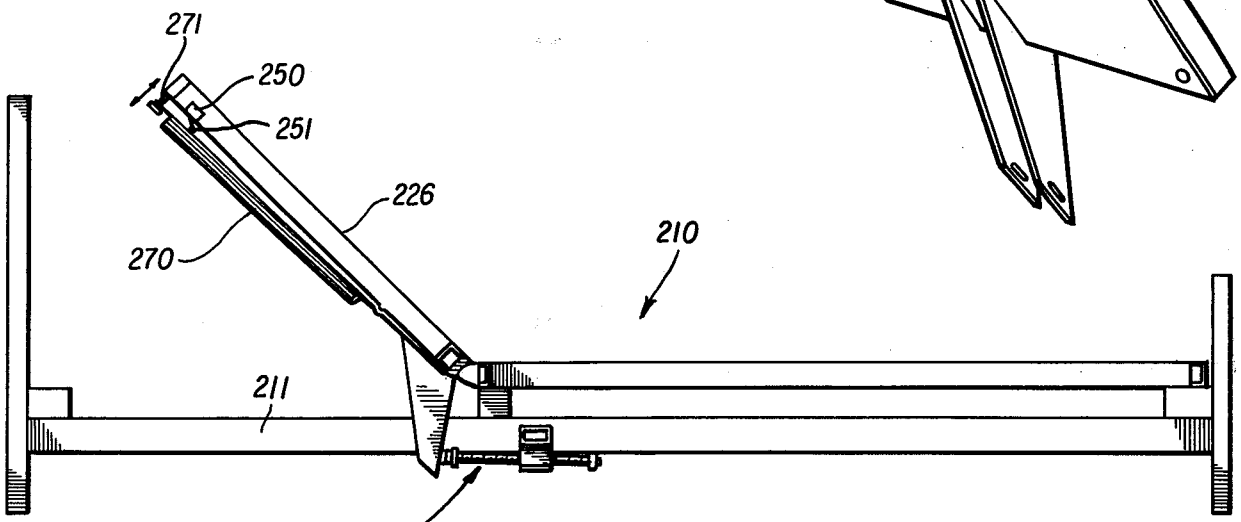
FIG. 13 is a side view of a third embodiment of an adjustable bed of the present invention.
Figure 15:
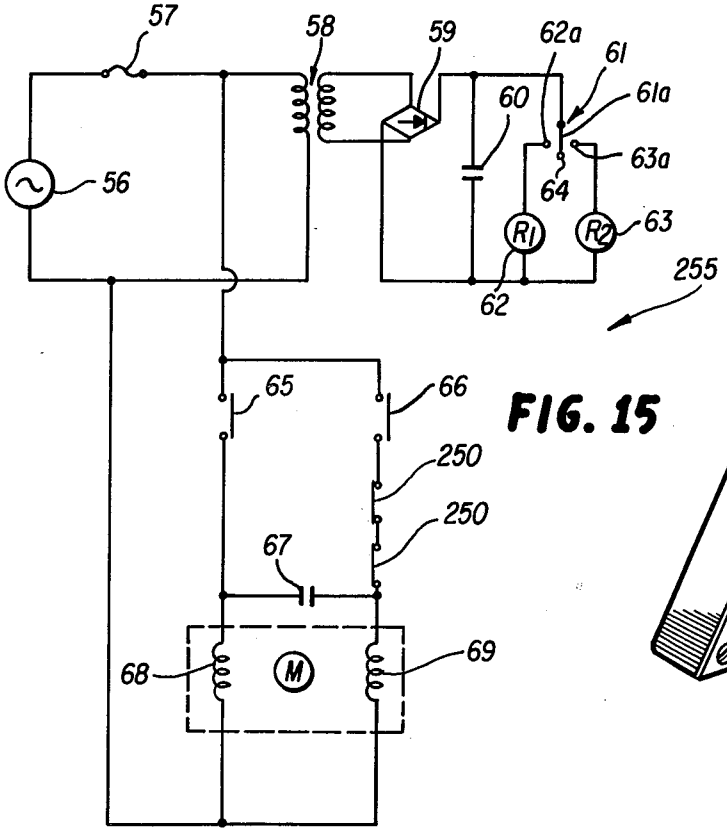
FIG. 15 is a circuit diagram showing a circuit for controlling the motor of the adjustable bed in FIG. 13.

In FIGS. 13 through 15, a movable board 226 is substantially identical to the movable board 126 as described hereinabove and shown in FIG. 11 and movable board 226 is provided at the lower side thereof with a pair of limit switches 250 (only one shown), a pair of pins 271, and a panel 270. A right end portion of panel 270 is fixed to a right end portion of movable board 226 so that a left end portion of panel 270 may be located away from a left end portion of board 226. The left end portion of panel 270 is in abutment with a pair of levers 251 (only one of which is shown) of limit switches 250 and movement of the left end portion of panel 270 into contact with the left end portion of movable board 226 is guided along pins 271. Movable board 226 is rotated upwardly and downwardly in a manner similar to movable board 126 described hereinabove (see particularly FIG. 10) by motor 238 (not shown) and drive transmission mechanism 237. Circuit 255 for motor 238 is substantially the same in construction and operation as circuit 155 discussed hereinabove with the exception that the single limit switch 150 of circuit 155 is replaced by the two limit switches 250 in circuit 255. During normal upwardly and downwardly rotation of movable board 226 the left end portion of panel 270 is spaced apart from the left end portion of movable board 226 and the levers 251, abutting panel 270, so as to maintain the limit switches 250 in the "on" condition. If a portion of the human body is caught between frame 211 and panel 270, the left end portion of panel 270 is pushed into contact with the left end portion of movable board 226 by guided movement along pins 271 and this contacting movement between panel 270 and board 226 moves levers 251 such that limit switches 250 are disengaged, thus stopping motor 238 and preventing further rotation of board 226. The other portions of an adjustable bed 210 are similar to those of adjustable bed 110 discussed hereinabove.

Figure 16:
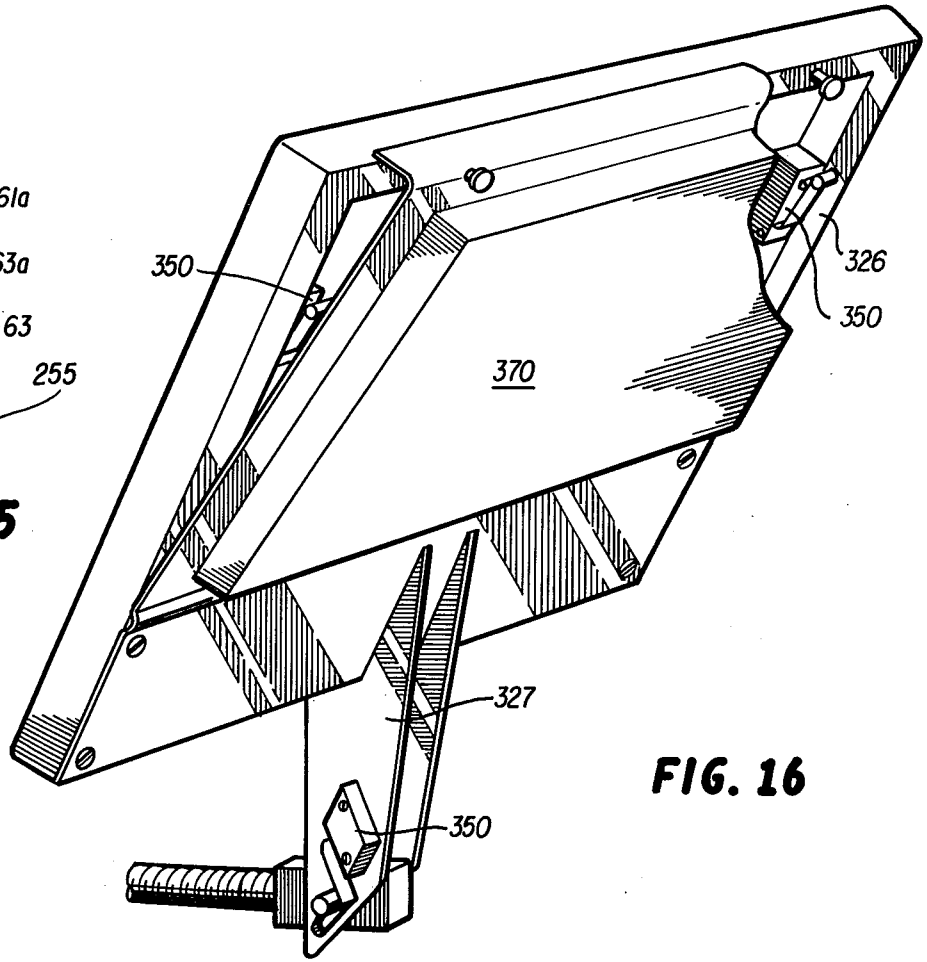
FIG. 16 is a perspective view of a major portion of a fourth embodiment of the adjustable bed of the present invention.

FIG. 16 shows a combination of the second (see FIGS. 9–12) and third (see FIGS. 13–15) embodiments described hereinabove and wherein three limit switches 350 are provided for a movable board 326. Two of the switches 350 are so located at a lower side of movable board 326 such that these two switches 350 may be turned off by a panel 370 when a portion of the human body is caught between panel 370 and a frame (not shown) as described in the embodiment of FIGS. 13–15. The remaining limit switch 350 is positioned at an arm 327 and operates in a manner as described in the embodiment of FIG. 10 so that the third limit switch 350 may be turned off for stopping a motor 338 (not shown) if the two switches 350 of movable board have not been turned off by a potion of a human body interposed between the frame and movable board 326. The other portions of the adjustable bed are similar to those described hereinabove. An electric circuit for this embodiment is similar in construction and operation as circuit 255 of FIG. 15 with the exception that the two limit switches 250 of circuit 255 are replaced by the three limit switches 350 described hereinabove.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An adjustable bed comprising:

a frame;

a stationary board fixedly mounted on said frame;

a movable board mounted on said frame and positioned in a horizontal position with said stationary board in a plane parallel with said frame;

driving means for moving said movable board out of the horizontal plane formed by said stationary board, said driving means comprising a motor, a circuit for controlling said motor, and a drive transmitting mechanism disposed between said motor and said movable board; and safety means for stopping operation of said motor when a portion of the human body is caught between said frame and said movable board during lowering thereof so as to prevent injury to the body, said safety means comprising switch means included in said circuit for stopping said motor and detecting means for disconnecting said switch means.

2. An adjustable bed in accordance with claim 1 wherein said movable board and said stationary board are located respectively at a head board side and a foot board side of said frame.

3. An adjustable bed in accordance with claims 1 or 2 further comprising arm means extending downwardly from a lower side of said movable board in an outwardly direction and having a slot provided therein, said detecting means comprising a pin connected with said drive transmitting mechanism and in sliding engagement with said slot provided in said arm means, said switch means further comprising a lever fixed to said arm means and engaged with said pin such that said switch means is disconnected after a predetermined retractive stroke of said pin when a portion of the human body is caught between said movable board and said frame.

4. An adjustable bed in accordance with claims 1 or 2 further comprising pin means mounted on said movable board, said switch means also being mounted on said movable board at a lower side thereof, said detecting means comprising a panel fixed at a first end portion thereof to one end portion of a lower side of said movable board such that a second end portion of said panel is disposed a predetermined distance from an upper end portion of said movable board and is guided by said pin means such that said switch means is by the first end portion of said panel when a portion of the human body is caught between said panel and said frame.

5. An adjustable bed in accordance with claim 1 wherein said movable board is divided into a first section and a second section, said second section being mounted so as to be movable out of the horizontal plane in conjunction with said first section.

6. An adjustable bed in accordance with claim 5 wherein said detecting means comprises first and second pairs of lever means, rotatably mounted respectively to lateral opposite sides of said first and second sections and further comprising switch members connected to said first and second pairs of levers.

7. An adjustable bed in accordance with claim 6 wherein said movable board and said stationary board are located respectively at a foot board side and a head board side of said frame.

8. An adjustable bed comprising:

a frame;

a stationary board fixedly mounted on said frame;

a first movable board mounted on said frame and located at a foot board side of said frame, said first movable board being in a horizontal position with said stationary board in a plane parallel with said frame; at a head board side of said frame, said second movable board being in a horizontal position with said stationary board in a plane parallel with said frame;

first driving means for moving said first movable board out of the horizontal plane formed by said stationary board, said first driving means comprising a first motor, a first circuit for controlling said first motor, and a first drive transmitting mechanism disposed between said first motor and said first movable board;

second driving means for moving said second movable board out of the horizontal plane formed by said stationary board, said second driving means comprising a second motor, a second circuit for controlling said second motor and a second drive transmitting mechanism disposed between said second motor and said second movable board; and safety means for stopping operation of said first motor of said first circuit when a portion of the human body is caught between said frame and said first movable board during lowering thereof so as to prevent injury to the body, said safety means comprising switch means included in said first circuit for stopping said first motor and detecting means for disconnecting said switch means.

9. An adjustable bed in accordance with claim 8 said first movable board comprising a first section and a second section, the second section being mounted so as to be movable out of the horizontal plane in conjunction with said first section.

10. An adjustable bed in accordance with claim 9 wherein said detecting means comprises first and second pairs of lever means, rotatably mounted respectively to lateral opposite sides of said first and second sections and further comprising switch members connected to said first and second pairs of levers.

* * * * *

UNITED STATES PATENT AND TRADEMARK OFFICE

CERTIFICATE OF CORRECTION

PATENT NO. :4,463,463

DATED :August 7, 1984

INVENTOR(S) :Kenichi Kaneko

It is certified that error appears in the above-identified patent and that said Letters Patent is hereby corrected as shown below:

Column 1, line 21, should read -- ...portion of the human body. --

Column 2, line 28,"24" in line 29 should be moved right after "...eighth supporting member".

Column 3, line 15, "48a" should go after "...the central portion".

Column 3, 4, lines 67-68, the first sentence in this paragraph should either be connected to next sentence with a comma after "illustrated," or should leave out "wherein."

Column 4, line 26, "on" should read -- "on" --.

Column 4, line 38, "off" should read -- "off" --.

Column 6, line 44, "disconnected" should go before "...by the first end portion...".

Column 7, lines 1-4, this should read:

"...frame;
a second movable board mounted on said frame and located..."

Signed and Sealed this

*Twelfth* Day of *February 1985*

[SEAL]

*Attest:*

DONALD J. QUIGG

*Attesting Officer* *Acting Commissioner of Patents and Trademarks*